US006041100A

United States Patent [19]

Miller et al.

[11] Patent Number: 6,041,100

[45] Date of Patent: Mar. 21, 2000

[54] COOLING DEVICE FOR X-RAY TUBE BEARING ASSEMBLY

[75] Inventors: Lester D. Miller, Hudson, Ohio; Mark S. Maska, Palatine; Andrew R. Kaczmarek, Jr., Compton, both of Ill.

[73] Assignee: Picker International, Inc., Cleveland, Ohio

[21] Appl. No.: 09/063,073

[22] Filed: Apr. 21, 1998

[51] Int. Cl.[7] ..... H01J 35/10

[52] U.S. Cl. ..... 378/141; 378/142; 378/144

[58] Field of Search ..... 378/141, 144, 378/132, 130, 142

[56] References Cited

U.S. PATENT DOCUMENTS 3,942,059 3/1976 Tran-Quang .
4,071,768 1/1978 Goodenough ..... 250/444
4,415,025 11/1983 Horvath ..... 165/185
5,416,820 5/1995 Weil et al. .
5,673,301 9/1997 Tekriwal .

*Primary Examiner*—David P. Porta
*Assistant Examiner*—Michael J. Schwartz
*Attorney, Agent, or Firm*—Timothy B. Gurin; John J. Fry; Eugene E. Clair

[57] ABSTRACT

An x-ray tube is disposed within an x-ray tube housing defining a chamber filled with oil or other cooling medium for cooling the x-ray tube. The x-ray tube includes an envelope enclosing an evacuated chamber in which an anode assembly is rotatably mounted to a bearing assembly and interacts with a cathode assembly for production of x-rays. The bearing assembly includes a bearing housing and a plurality of bearings disposed on a surface of the bearing housing. A heat sink is coupled to the bearing assembly and provides a thermally conductive path between the bearing assembly and the cooling medium in the x-ray tube housing for providing direct cooling of the bearing assembly during operation.

24 Claims, 5 Drawing Sheets

COOLING DEVICE FOR X-RAY TUBE BEARING ASSEMBLY

TECHNICAL FIELD

The present invention relates to x-ray tube technology. More specifically, the present invention relates to reducing the heating effects on x-ray tube bearings caused by heat dissipated from the anode during operation.

BACKGROUND OF THE INVENTION

Conventional diagnostic use of x-radiation includes the form of radiography, in which a still shadow image of the patient is produced on x-ray film, fluoroscopy, in which a visible real time shadow light image is produced by low intensity x-rays impinging on a fluorescent screen after passing through the patient, and computed tomography (CT) in which complete patient images are digitally constructed from x-rays produced by a high powered x-ray tube rotated about a patient's body.

Typically, an x-ray tube includes an evacuated envelope made of metal or glass which is supported within an x-ray tube housing. The x-ray tube housing provides electrical connections to the envelope and is filled with a cooling medium such as oil to aid in cooling components housed within the envelope. The envelope and the x-ray tube housing each include an x-ray transmissive window aligned with one another such that x-rays produced within the envelope may be directed to a patient or subject under examination.

In order to produce x-rays, the envelope houses a cathode assembly and an anode assembly. The cathode assembly includes a cathode filament through which a heating current is passed. This current heats the filament sufficiently that a cloud of electrons is emitted, i.e., thermionic emission occurs. A high potential, on the order of 100–200 kV, is applied between the cathode assembly and the anode assembly. This potential causes the electrons to flow from the cathode assembly to the anode assembly through the evacuated region in the interior of the envelope. A cathode focusing cup containing the cathode filament focuses the electrons onto a small area or focal spot on a target of the anode assembly. The electron beam impinges the target with sufficient energy that x-rays are generated. A portion of the x-rays generated pass through the x-ray transmissive windows of the envelope and x-ray tube housing to a beam limiting device, or collimator, attached to the x-ray tube housing. The beam limiting device regulates the size and shape of the x-ray beam directed toward a patient or subject under examination thereby allowing images to be constructed.

In order to distribute the thermal loading created during the production of x-rays a rotating anode assembly configuration has been adopted for many applications. In this configuration, the anode assembly is rotated about an axis such that the electron beam focused on a focal spot of the target impinges on a continuously rotating circular path about a peripheral edge of the target. Each portion along the circular path becomes heated to a very high temperature during the generation of x-rays and is cooled as it is rotated before returning to be struck again by the electron beam. In many high powered x-ray tube applications such as CT, the generation of x-rays often causes the anode assembly to be heated to a temperature range of 1200–1400° C., for example.

In order to provide for rotation, the anode assembly is typically mounted to a rotor which is rotated by an induction motor. The rotor in turn is rotatably supported by a bearing assembly. The bearing assembly provides for a smooth rotation of the rotor and anode assembly about its axis. The bearing assembly typically includes at least two sets of ball bearings disposed in a bearing housing. The ball bearings often consist of a ring of metal balls which are lubricated by application of lead or silver to an outer surface of each ball thereby providing support to the rotor with minimal frictional resistance.

During operation of the x-ray tube, the anode assembly is passively cooled by use of oil or other cooling medium flowing within the housing which serves to absorb heat radiated by the anode assembly through the envelope. However, a portion of the heat radiating from the anode assembly is also absorbed by the rotor and bearing assembly. For example, referring to FIG. 2, heat 11 radiated from the anode assembly 50 is typically conducted along stem 74 to the bearing assembly 85 and ultimately to ball bearings 92*a*, 92*b* via a thermally conductive path P1. Such heat has been found to subject the bearing assembly to temperatures of approximately 400° C. in many high powered applications. Unfortunately, such heat transfer to the bearings may deleteriously effect the bearing performance. For instance, prolonged or excessive heating to the lubricant applied to each ball of a bearing can reduce the effectiveness of such lubricant. Further, prolonged and/or excessive heating may also deleteriously effect the life of the bearings and thus the life of the x-ray tube.

One known method to reduce the amount of heat passed from the anode assembly to the bearing assembly is to mechanically secure a heat shield to the rotor. The heat shield serves to protect the bearing assembly from a portion of the heat radiated from the anode assembly in the direction of the bearing assembly. Unfortunately, heat shields are not able to fully protect the bearing assembly from heat transfer from the anode assembly and a portion of the heat radiated is still absorbed by the bearing assembly. Additionally, although the heat shield is useful in preventing some heat transfer to the bearing assembly, the heat shield does not play a role in cooling the bearing assembly of heat already absorbed therein. Further, given that the bearing assembly is enclosed by the rotor, the bearing assembly is not able to easily radiate heat to the cooling medium.

Therefore, what is needed is an apparatus for reducing the heating effects on x-ray tube bearings caused by heat dissipated from the anode assembly which overcomes the shortfalls discussed above and others.

SUMMARY OF THE INVENTION

In one embodiment of the present invention, an x-ray tube is disposed within an x-ray tube housing defining a chamber filled with oil or other cooling medium for cooling the x-ray tube. The x-ray tube includes an envelope enclosing an evacuated chamber in which an anode assembly is rotatably mounted to a bearing assembly and interacts with a cathode assembly for production of x-rays. A thermally conductive path is provided between the bearing assembly and the cooling medium thereby allowing heat absorbed by the bearing assembly to be transferred to the cooling medium. The thermally conductive path is provided by way of a metal heat sink coupled at one end to the bearing assembly and at an opposite end to an anode support bracket disposed within the housing for supporting the x-ray tube. The end of the heat sink coupled to the support bracket also includes a heat exchange flange having a plurality of cooling passages through which cooling medium flowing through the housing is pumped. Thus, heat transferred to the bearing assembly is able to pass through the heat sink to the heat exchange flange where it is absorbed by cooling fluid and removed from the x-ray tube housing.

According to one aspect of the present invention, an x-ray apparatus is provided. The x-ray apparatus includes a housing filled with a cooling medium and an x-ray tube disposed within the housing and surrounded by the cooling medium. The x-ray tube includes a cathode assembly including a filament which emits electrons when heated, an anode assembly defining a target for intercepting the electrons such that collision between the electrons and the anode assembly generate x-rays from an anode focal spot, a bearing assembly rotatably supporting the anode assembly, and an envelope enclosing the anode assembly and the cathode assembly in a vacuum. The x-ray apparatus further includes a means for providing a thermally conductive path between the bearing assembly and the cooling medium.

According to a more limited aspect of the present invention, the means for providing a thermally conductive path is a heat sink coupled at one end to the bearing assembly and exposed at an opposite end to the cooling medium.

In accordance with another aspect of the present invention, a device for providing a thermally conductive path between a bearing assembly disposed within an x-ray tube and a cooling medium disposed outside of the x-ray tube is provided. The device includes a thermally conductive heat sink coupled to the bearing assembly wherein a portion of the heat sink is disposed inside the x-ray tube and a portion of the heat sink is disposed outside of the x-ray tube.

In accordance with yet another aspect of the present invention a method of cooling a bearing assembly disposed within an x-ray tube is provided. The method including the step of pumping a cooling medium across a surface of a thermally conductive heat sink coupled to the bearing assembly.

It is an advantage of the present invention that a thermally conductive path between the bearing assembly and the cooling medium is provided thereby allowing heat transferred to the bearing assembly to be readily absorbed by the cooling medium.

It is another advantage of the present invention that the size, shape and material of the heat sink is such that a secure and reliable connection is maintained between the x-ray tube and the housing without sacrifacing thermal conductivity.

It is still another advantage of the present invention that the heat sink is adapted for use with existing bearing assembly designs.

To the accomplishment of the foregoing and related ends, the invention then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE PREFERRED EMBODIMENTS

Figure 1:
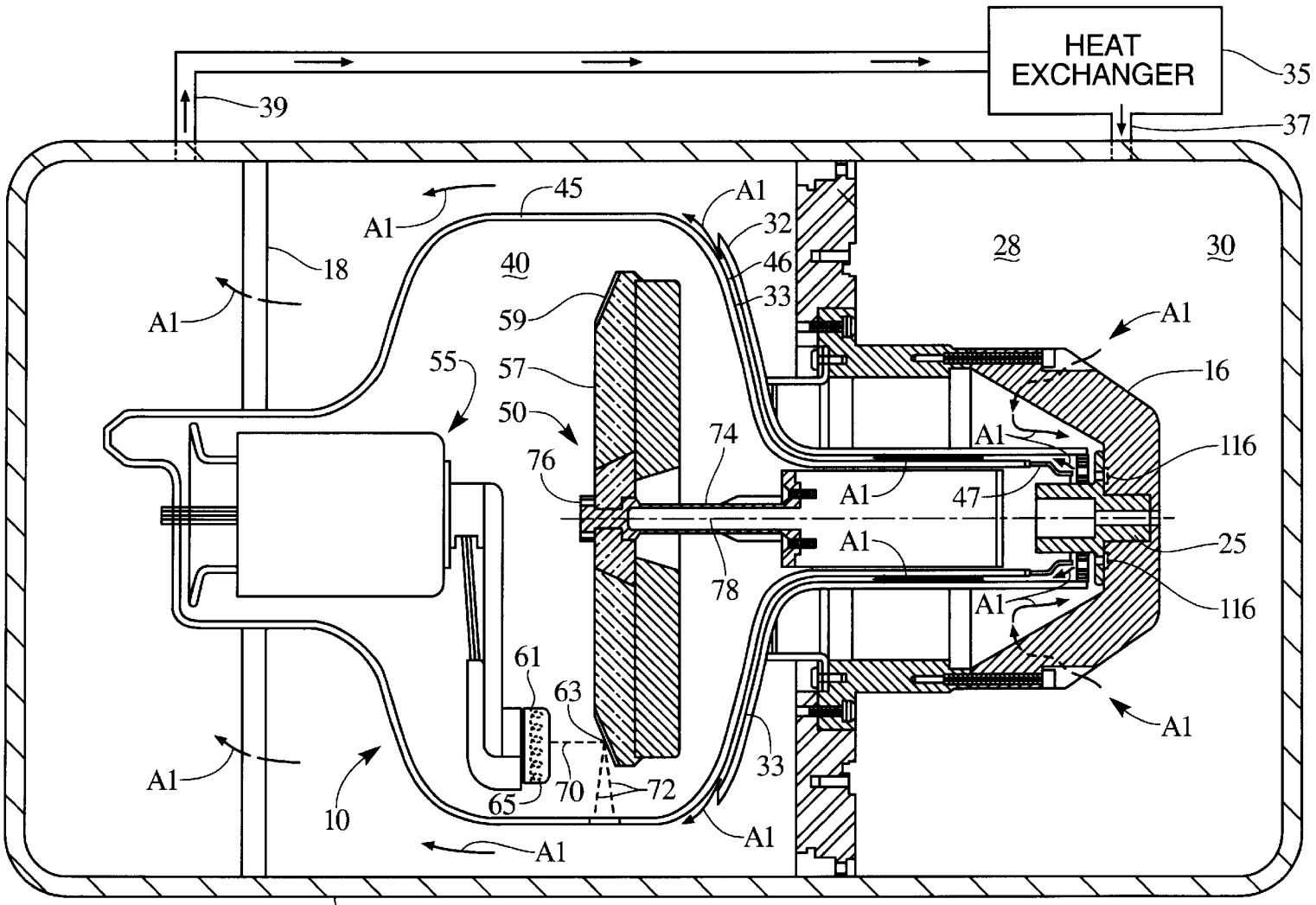
FIG. 1 is a partial cross sectional view of an x-ray apparatus in accordance with the present invention.

The present invention will now be described with reference to the drawings in which like reference numerals are used to refer to like elements throughout.

Turning now to FIG. 1, an x-ray tube 10 is mounted within an x-ray tube housing 12. The x-ray tube 10 is mounted within the housing 12 in a predominantly conventional manner by way of an anode bracket 16 and a cathode bracket 18 except that a heat sink 25 is used to secure the x-ray tube 10 to the anode bracket 16 as discussed in more detail below.

The housing 12 defines a chamber 28 filled with oil 30 for cooling the x-ray tube 10. It will be appreciated that other suitable cooling mediums other than oil 30 may also be used. The oil 30 within the chamber 28 is pumped through the x-ray tube housing 12 to absorb heat from the x-ray tube 10 and transfer such heat to a heat exchanger 35 disposed outside the x-ray tube housing 12. An oil shield 32 is secured in a spaced apart relationship about an envelope 45 of the x-ray tube 10 so as to define an oil flow path 33 across an outer surface 46 of the envelope 45 as is done in conventional x-ray tube designs except that in the present invention the oil 30 entering the oil flow path 33 must first flow through the heat sink 25 as discussed below more fully. The heat exchanger 35 is coupled to the housing 12 by way of inlet port 37 and outlet port 39 and also serves to controls the flow rate of oil through the inlet port 37.

The x-ray tube envelope 45 defines an evacuated chamber or vacuum 40. In the preferred embodiment, the envelope 45 is made of glass although other suitable material including other ceramics or metals could also be used. The envelope 45 is sealed at one end to the bearing assembly 85 (see FIG. 2) using a kovar and nickel seal 47 so as to maintain the integrity of the vacuum 40. Disposed within the envelope 45 is an anode assembly 50 and a cathode assembly 55. The anode assembly 50 includes a circular target 57 having a focal track 59 along a peripheral edge of the target 57. The focal track 59 is comprised of a tungsten alloy or other suitable material capable of producing x-rays. The cathode assembly 55 is stationary in nature and includes a cathode focusing cup 61 positioned in a spaced relationship with respect to the focal track 59 for focusing electrons to a focal spot 63 on the focal track 59. A cathode filament 65 (shown in phantom) mounted to the cathode focusing cup 61 is energized to emit electrons 70 which are accelerated to the focal spot 63 to produce x-rays 72.

Figure 2:
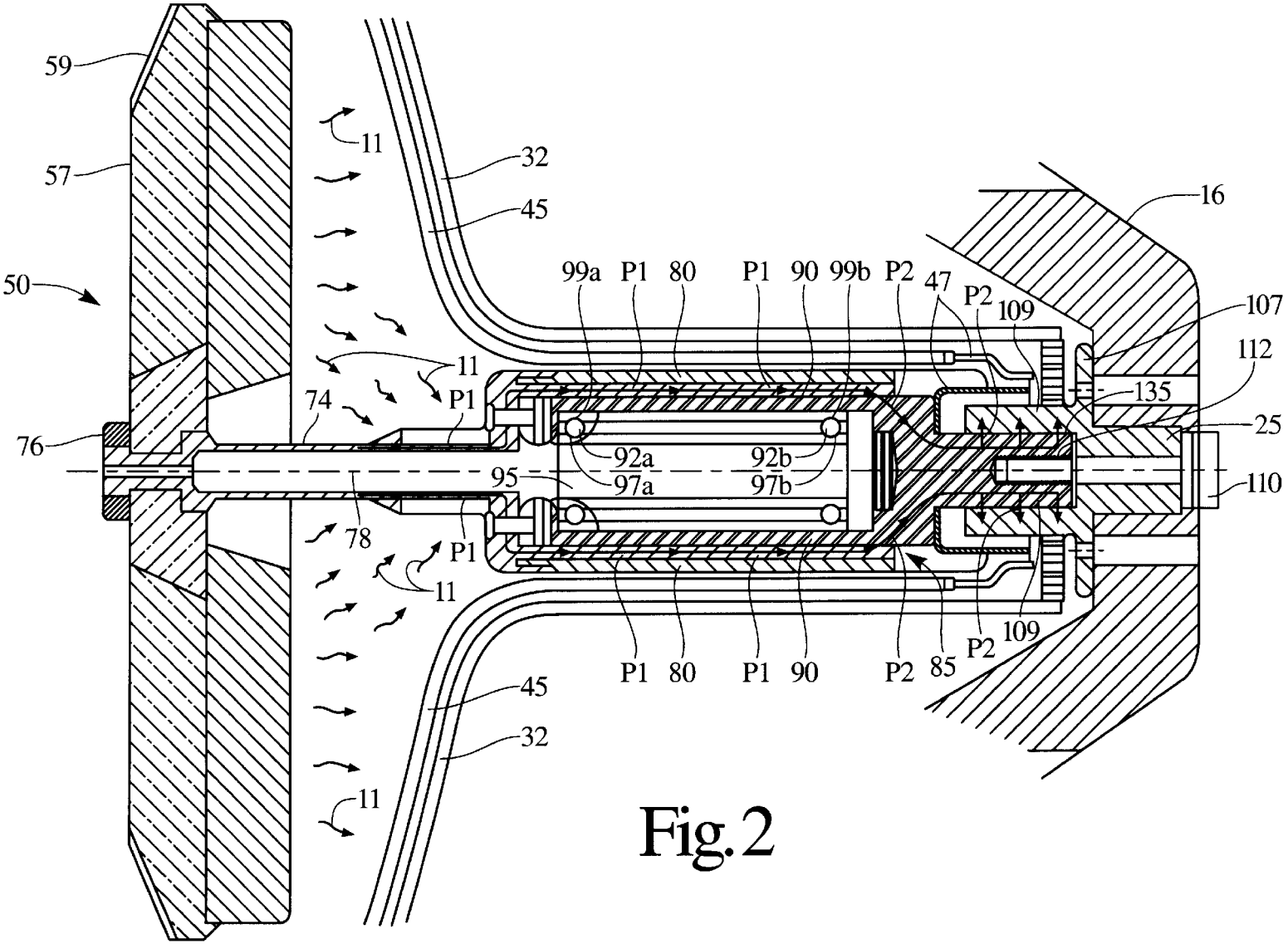
FIG. 2 is an enlarged cross sectional view of a bearing assembly of the x-ray apparatus of FIG. 1.

Referring now to FIGS. 1 and 2, the anode assembly 50 is mounted to a rotor stem 74 using securing nut 76 and is rotated about an axis of rotation 78 during operation. The rotor stem 74 is connected to a rotor body 80 which is rotated about the axis 78 by an electrical stator (not shown). The rotor body 80 houses a bearing assembly 85 which is coupled at one end to the heat sink 25 as discussed in more detail below. The bearing assembly 85 includes a bearing housing 90, ball bearings 92*a*, 92*b*, and a bearing shaft 95. The bearing shaft 95 is coupled to the rotor body 80 and rotatably supports the anode assembly 50. The bearing shaft 95 also defines a pair of inner races 97*a*, 97*b*, which provide for inner race rotation of the bearings 92*a*, 92*b*, respectively.

Corresponding outer races 99*a*, 99*b* are defined in the bearing housing 90. Each bearing 92*a*, 92*b*, is comprised of multiple metal balls which surround the bearing shaft 95. In the present embodiment, the metal balls are made of high speed steel, each coated with a lead or silver lubricant to provide for reduced frictional contact.

Figure 3:
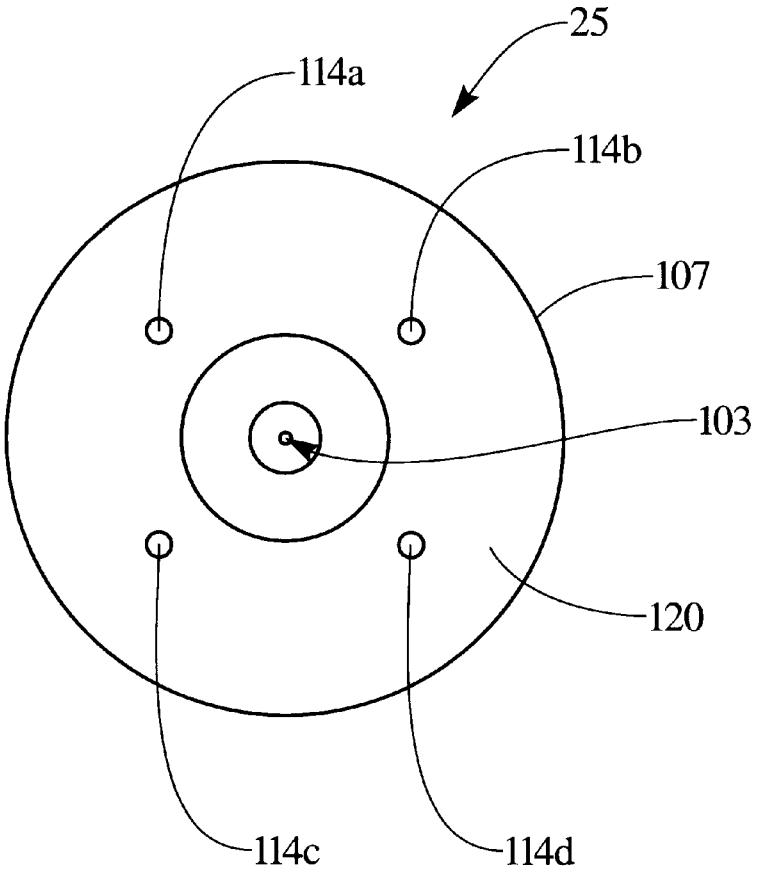
FIG. 3 is a plan view of a securing flange of a heat sink shown in FIG. 1.
Figure 4:
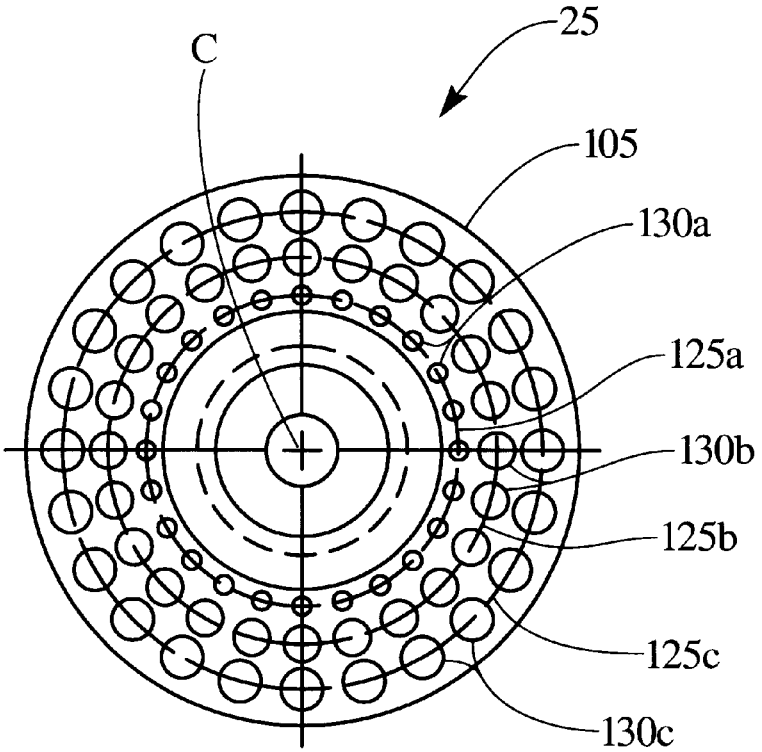
FIG. 4 is a plan view of a heat exchange flange of the heat sink shown in FIG. 1.
Figure 5:
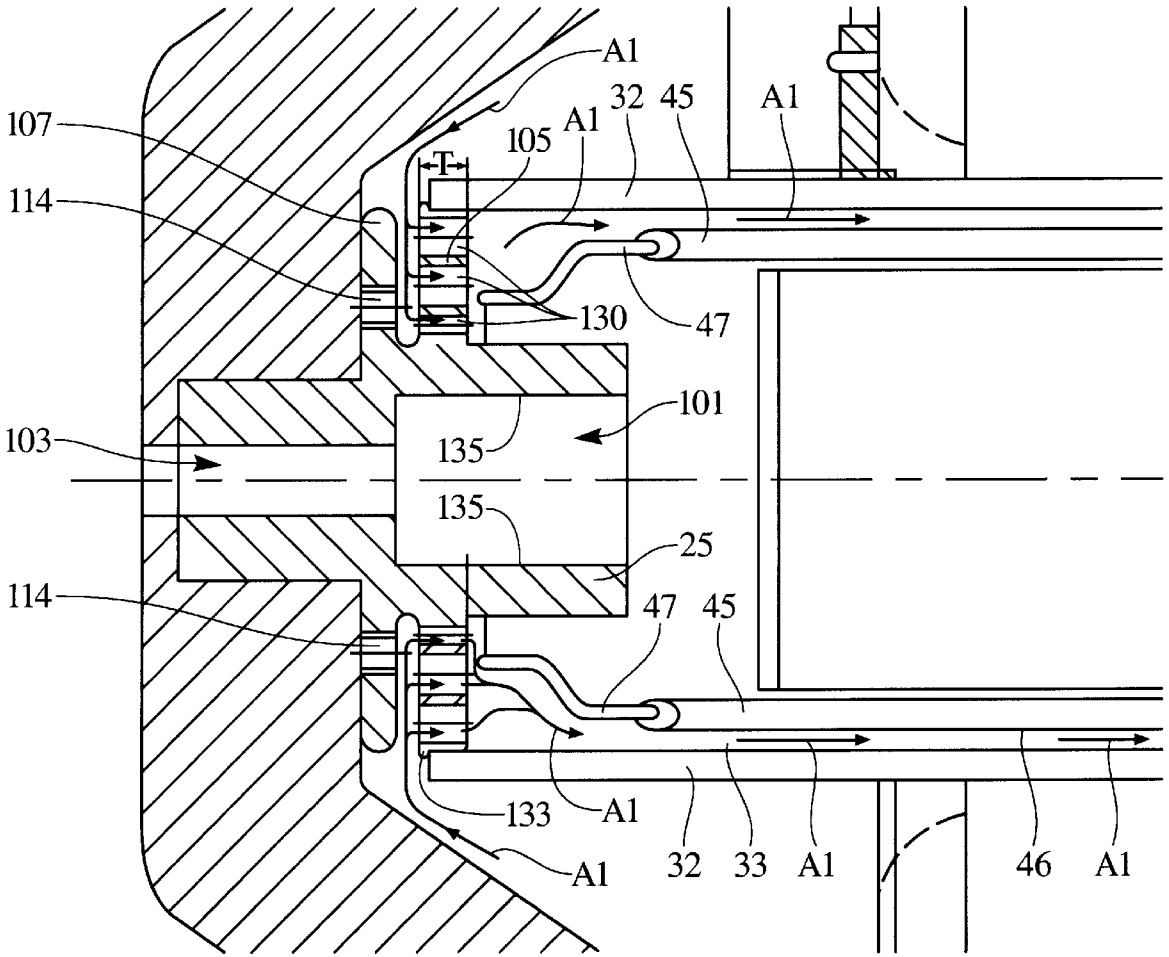
FIG. 5 is an enlarged view of a portion of the x-ray apparatus shown in FIG. 1 showing the flow of oil.

Referring now to FIGS. 3–5, the heat sink 25 is shown in more detail. As discussed below, the heat sink 25 provides a path for thermally conducting heat from the bearing assembly 85 to the oil 30 within the housing 12. The heat sink 25 of the present embodiment is made of zirconium copper, however, it will be appreciated that other thermally conductive material capable of reliably securing the x-ray tube 10 to the anode bracket 16 such as copper or Glidcop could alternatively be used.

As best seen in FIG. 5, the heat sink 25 includes a receiving cavity 101, a securing cavity 103, a heat transfer flange 105, and a securing flange 107. The receiving cavity 101 is sized to frictionally receive a support end 109 of the bearing housing 90 for securing the bearing assembly 85 to the anode bracket 16. A braze or other bonding material having thermally conductive properties such as silocone compounds and the like may additionally be placed within the receiving cavity 101 for further securing the support end 109 of the bearing housing 90 therein and/or increasing heat transfer properties. The securing cavity 103 provides an opening through which an anode mounting bolt 110 (see FIG. 2) is able to pass and attach to a threaded aperture 112 within the support end 109 of the bearing assembly 85. The securing bolt 110 serves as a primary support and securing means for connecting the x-ray tube 10 to the anode bracket 16. Additional support between the anode bracket 16 and heat sink 25 is obtained by virtue of the securing flange 107. More specifically, as shown in FIG. 3, the securing flange 107 of the present embodiment includes four threaded apertures 114 which are used to further secure the heat sink 25 to the anode bracket 16 using corresponding securing screws 116 (shown in phantom in FIG. 1). A face 120 of the securing flange 107 abuts the anode bracket 16 when secured thereto and provides extra support to minimize x-ray tube 10 wobble and vibration during operation.

Referring now to FIG. 4, the heat transfer flange 105 is shown in more detail. The heat transfer flange 105 of the present embodiment includes three concentric rings 125*a*, 125*b*, 125*c* of twenty-four cooling passages 130*a*, 130*b*, 130*c* (collectively referred to as cooling passages 130). The cooling passages 130*a* of ring 125*a* are all of a same smaller diameter than the cooling passages 130*b* of ring 125*b* which are in turn smaller than the cooling passages 130*c* of ring 125*c*. For instance, in the present embodiment, the diameters of the cooling passages 130*a* are each 0.062 inches, the diameter of cooling passages 130*b* are each 0.125 inches, and the diameter cooling passages 130*c* are each 0.160 inches. A thickness T (see FIG. 5) of the heat transfer flange 105 is also selected to obtain desired cooling effects and in the present invention is set to 0.175 inches. As discussed in more detail below, the cooling passages 130 are provided to allow oil 30 to flow through the heat sink 25 and absorb heat which is transferred to the heat sink 25 from the bearing assembly 85. The shape, size and thickness of the cooling passages 130 are specifically configured to allow substantial cooling in a region 135 where the support end 109 of the bearing housing 90 is received by the receiving cavity 101 of the heat sink 25 while still allowing proper flow of oil through the oil flow path 33.

Referring to FIG. 5, an outer periphery of the heat transfer flange 105 also includes a receiving groove 133 for receiving an end of the oil shield 32. A frictional fit is maintained between the receiving groove 133 and the oil shield 32 sufficient to ensure little to no oil flow between this junction as opposed to such oil flowing through the cooling passages 130 in the heat exchange flange 105 as is desired.

In operation, oil 30 which is pumped through the x-ray tube housing 12 to remove heat which is radiated from the anode assembly 50 is also used to remove heat which is thermally conducted to the bearing assembly 85. More specifically, as x-rays are produced on the target 57 during operation, resulting heat which is transferred to the bearing assembly 85 along path P1 (as shown in FIG. 2) may be removed from the bearing assembly 85 through path P2 which provides a thermally conductive path from the bearing assembly 85 to the oil 30 in the housing 12. As is conventional, a large portion of the oil 30 which is pumped through the housing 12 is typically forced to flow through the oil flow path 33 between the oil shield 32 and the outer surface 46 of the x-ray tube envelope 45. The oil is forced through the oil flow path 33 by virtue of the anode bracket 16 substantially blocking the flow of oil in other directions as is conventional. More particularity, in order to direct the flow of oil 30, the anode bracket 16 and cathode bracket 18 includes a plurality of oil through holes (not shown) at selected locations through which the oil 30 may pass from one side of the brackets 16, 18 to another. Thus, as shown in FIGS. 1 and 5, the oil 30 is primarily forced to flow in a direction of arrows A1. The rate of flow of the oil 30 is controlled by an oil pump in the heat exchanger 35 and in the current embodiment the oil 30 is pumped through the x-ray tube housing 12 at a rate of eight gallons/min. It will be appreciated, however, that the oil flow rate may be varied depending on the desired cooling effects for a given x-ray tube 10.

According to the present invention, the heat sink 25 coupled to the bearing assembly 85 is directly exposed to, and placed in the flow of, the oil 30 so as to provide a means for directly cooling the bearing assembly 85 through thermal conduction. More specifically, as shown in FIG. 5, prior to entering the oil flow path 33, the oil 30 passes through the cooling passages 130 in the heat transfer flange 105. As the oil 30 passes through the cooling passages 130, heat from the heat sink 25 is transferred or absorbed by the oil thereby effectively cooling the heat sink 25. Since the heat sink 25 is directly coupled to the bearing housing 90 via receiving cavity 101, the bearing assembly 85 is also effectively cooled. In this manner, heat which is transferred to the bearing assembly 85 by the anode assembly 50 may be directly and efficiently removed from the bearing assembly 85 thereby extending its overall life.

Although the present embodiment discusses the use of concentric rings of cooling passages 130 in the heat transfer flange 105 to serve as cooling passages for the oil 30, it will be appreciated that a variety of other configurations may alternatively be used. More specifically, while the concentric rings of cooling passages 130 provides an arrangement which allows the oil 30 to significantly draw heat from the region 135 where the support end 109 of the bearing housing 90 is received by the receiving cavity 101, other cooling passage shapes, sizes and arrangements may be adequate for this purpose. For example, the cooling passages may consist of a plurality of slots extending radially away from a center C (see FIG. 4) of the heat transfer flange 105 or of a variety of other shapes and sized passages. In general, selection of the placement and geometry of cooling passages to be included in the heat transfer flange 105 is such that a maximum surface area of the heat transfer flange 105 is exposed to the oil so as to provide significant cooling effects to the bearing assembly 85 while still allowing the oil 30 to freely flow into the oil flow passage 33.

The invention has been described with reference to the preferred embodiments. Obviously, modifications and alterations will occur to others upon reading and understanding the preceding detailed description. It is intended that the invention be construed as including all such modifications, alterations and others insofar as they come within the scope of the appended claims or their equivalence thereof.

What is claimed is:

1. An x-ray apparatus comprising:

a housing filled with a cooling medium;

an x-ray tube disposed within the housing and surrounded by the cooling medium, the x-ray tube including:

an envelope defining an evacuated chamber;

a cathode assembly disposed in the envelope, said cathode assembly including a filament which emits electrons when heated;

an anode assembly disposed in the envelope, the anode assembly defining a target for intercepting the electrons such that collision between the electrons and the anode assembly generate x-rays from an anode focal spot; and a bearing assembly rotatably supporting the anode assembly; and means for providing a direct thermal connection between the bearing assembly and the cooling medium.

2. The x-ray apparatus of claim 1, wherein the bearing assembly includes a bearing housing and the direct thermal connection means is coupled to the bearing housing.

3. The x-ray apparatus of claim 2, wherein the means is a metal heat sink.

4. The x-ray apparatus of claim 3, wherein the heat sink is made of zirconium copper.

5. An x-ray apparatus comprising:

a housing filled with a cooling medium;

an x-ray tube disposed within the housing and surrounded by the cooling medium, the x-ray tube including:

an envelope defining an evacuated chamber;

a cathode assembly disposed in the envelope, said cathode assembly including a filament which emits electrons when heated;

an anode assembly disposed in the envelope, the anode assembly defining a target for intercepting the electrons such that collision between the electrons and the anode assembly generate x-rays from an anode focal spot; and a bearing assembly rotatably supporting the anode assembly; and a heat sink for providing a direct thermal connection between the bearing assembly and the cooling medium, wherein the heat sink includes a receiving cavity for receiving an end of the bearing housing.

6. The x-ray apparatus of claim 3, wherein the heat sink includes a heat transfer flange exposed to the cooling medium.

7. The x-ray apparatus of claim 6, wherein the heat transfer flange includes a plurality of cooling passages.

8. The x-ray apparatus of claim 7, wherein the plurality of cooling passages are positioned in concentric rings about a center of the heat transfer flange.

9. The x-ray apparatus of claim 8, wherein each of the plurality of cooling passages associated with a particular one of the concentric rings has a diameter of substantially equal size.

10. The x-ray apparatus of claim 9, wherein each of the cooling passages associated with a concentric ring closer to the center of the heat transfer flange have diameters smaller than the cooling passages associated with a concentric ring further from the center.

11. The x-ray apparatus of claim 6, wherein a peripheral edge of the heat transfer flange includes a receiving lip for receiving an end of a cooling medium direction shield disposed in the housing.

12. The x-ray apparatus of claim 6, wherein the heat sink further includes a securing flange for securing the heat sink to an anode bracket disposed within the x-ray tube housing.

13. The x-ray apparatus of claim 6, wherein the cooling medium is oil.

14. A device for providing a thermally conductive path between a bearing assembly disposed within an x-ray tube and a cooling medium disposed outside of the x-ray tube, the device comprising:

a heat sink coupled to the bearing assembly, the heat sink providing a thermally conductive path between the bearing assembly and the cooling medium, wherein the heat sink includes a receiving cavity for receiving an end of the bearing assembly.

15. The x-ray apparatus of claim 14, wherein the heat sink is made of zirconium copper.

16. The device of claim 14, wherein the heat sink includes a heat transfer flange.

17. The x-ray apparatus of claim 16, wherein the heat transfer flange includes a plurality of cooling passages.

18. The x-ray apparatus of claim 17, wherein the plurality of cooling passages are positioned in concentric rings about a center of the heat transfer flange.

19. The x-ray apparatus of claim 18, wherein each of the plurality of cooling passages associated with a particular one of the concentric rings has a diameter of substantially equal size.

20. The x-ray apparatus of claim 19, wherein each of the cooling passages associated with a concentric ring closer to the center of the heat transfer flange have diameters smaller than the cooling passages associated with a concentric ring further from the center.

21. A method of cooling a bearing assembly disposed within an x-ray tube, the method comprising the steps of:

rotatably supporting an anode assembly with the bearing assembly for rotation around an axis of rotation of the anode assembly;

pumping a cooling medium across a surface of a thermally conductive heat sink coupled to the bearing assembly.

22. The method of claim 21, wherein a plurality of cooling passages are defined through a surface of the heat sink and the cooling medium is pumped through the plurality of cooling passages.

23. The method of claim 22, wherein the heat sink is comprised of zirconium copper.

24. The method of claim 22, wherein the heat sink includes a receiving cavity for receiving an end of the bearing assembly.

* * * * *